United States Patent [19]

Sugahara

[11] 4,205,616

[45] Jun. 3, 1980

[54] SEWING MACHINE FOR SIMULTANEOUS HEM STITCHING AND BLIND STITCHING

[76] Inventor: Masato Sugahara, 28-12 Nishi Asakusa 3-chome, Taito-ku, Tokyo 111, Japan

[21] Appl. No.: 885,808

[22] Filed: Mar. 13, 1978

[30] Foreign Application Priority Data

Mar. 18, 1977 [JP] Japan ..... 52-29962

[51] Int. Cl.[2] ..... D05B 57/02; D05B 57/30

[52] U.S. Cl. ..... 112/177; 112/162; 112/200

[58] Field of Search ..... 112/177, 176, 162, 199, 112/200

[56] References Cited

U.S. PATENT DOCUMENTS

| | | | |
|---|---|---|---|
| 1,592,446 | 7/1926 | Dearborn | 112/176 |
| 1,926,644 | 9/1933 | Buono et al. | 112/177 |
| 2,193,180 | 3/1940 | Mann | 112/177 |
| 2,195,700 | 4/1940 | Kelso | 112/177 |
| 2,199,171 | 4/1940 | Gruman | 112/177 |
| 2,351,831 | 6/1944 | Muecke | 112/200 |
| 3,301,207 | 1/1967 | Reeber et al. | 112/200 |
| 3,952,674 | 4/1976 | Hirayama | 112/199 |
| 4,022,140 | 5/1977 | Lienemann | 112/199 |

*Primary Examiner*—Werner H. Schroeder
*Assistant Examiner*—Andrew M. Falik

[57] ABSTRACT

A sewing machine for simultaneously performing hem stitch and blind stitch. The sewing machine comprises a first looper placed above one end of a hem of cloth to be stitched and along the hem reciprocated to cross with a blind needle which is passed through the cloth; and a second looper placed above the hem to be stitched and adapted to move along a loop-like track which resembles the outline of a saddle and syncronizes generally with the reciprocation of said first looper.

11 Claims, 30 Drawing Figures

SEWING MACHINE FOR SIMULTANEOUS HEM STITCHING AND BLIND STITCHING

BACKGROUND OF THE INVENTION

In existing sewing machines for blind-stitch, the work piece is pushed up by a cloth lifting means adapted to press the cloth against an upper pressure plate. In the current sewing machine art, the upper pressure plate is disposed adjacent the sewing portion and along the feed direction of the cloth, in order to optimize the cloth pressing effect.

Further, in the hem stitch of a thin cloth, the hem pulled by a sewing thread curls easily. In order to prevent curling, a seam stabilizing piece like a springboard may be provided in the same manner as the upper pressure plate. Thus, since the current sewing machine for blind-stitch has to provide the cloth pressure plate or the like near the sewing portion, the looper of the blind stitch machine has its motion limited so as to not collide with the cloth pressure plate or the like. Consequently, the looper operates the sewing thread only by partial oscillation and can not form complicated seams.

Accordingly, in a cloth which is easily frayed, the hem stitch and the blind stitch must be done separately. Since the seam can not be formed by a sewing machine adapted for blind stitch, it has been essential to have two working processes that make first the hem stitch with an overlock sewing machine and then the blind stitch with the sewing machine for blind stitching. The present invention overcomes the necessity for performing separate operations, and provides a better finish on the seam than is available from separate operations.

BRIEF SUMMARY OF THE INVENTION

The present invention relates to a sewing machine adapted to simultaneously perform hem stitch and blind stitch.

It is an object of the present invention to provide a sewing machine devised to simultaneously perform a hem stitch and a blind stitch.

It is another object of the invention to provide a sewing machine for blind stitch in which two loopers are disposed to reciprocate along a hem of cloth to be stitched and in which a hem stitch and a blind stitch are simultaneously performed by two or three threads.

It is a further object of the invention to provide a sewing machine having a structure which can sew clothes with high efficiency and little trouble.

The above objects and advantages are accomplished by a sewing machine in which a first looper is placed above one side of a hem of cloth to be stitched and along the hem reciprocated to cross with a blind needle which is passed through the cloth; and a second looper which is placed above the hem to be stitched and adapted to draw in a saddle shape a loop-like track which syncronizes generally with the reciprocation of the first looper.

BRIEF DESCRIPTION OF THE DRAWINGS

These and other objects and advantages of the invention may be readily ascertained by referring to the following description and appended drawings in which:

FIG. 6(*b*) is a front view showing another embodiment of the same unit as shown in FIG. 6(*a*);

Referring to FIGS. 1 to 3, there is shown a sewing machine for blind stitch, in which each mechanism will be described in detail hereinafter.

A swinging mechanism of a first looper is constituted by a driving shaft 10 having an eccentric rotary body or a crank or a universal joint which is connected with a looper mounting unit 12 through the intermediary of a suitable link mechanism so as to swing the looper mounting unit 12. The looper mounting unit 12 is provided with a first looper 11 of hook shape at a leading end thereof to allow the looper 11 to circularly reciprocate.

Figure 1:
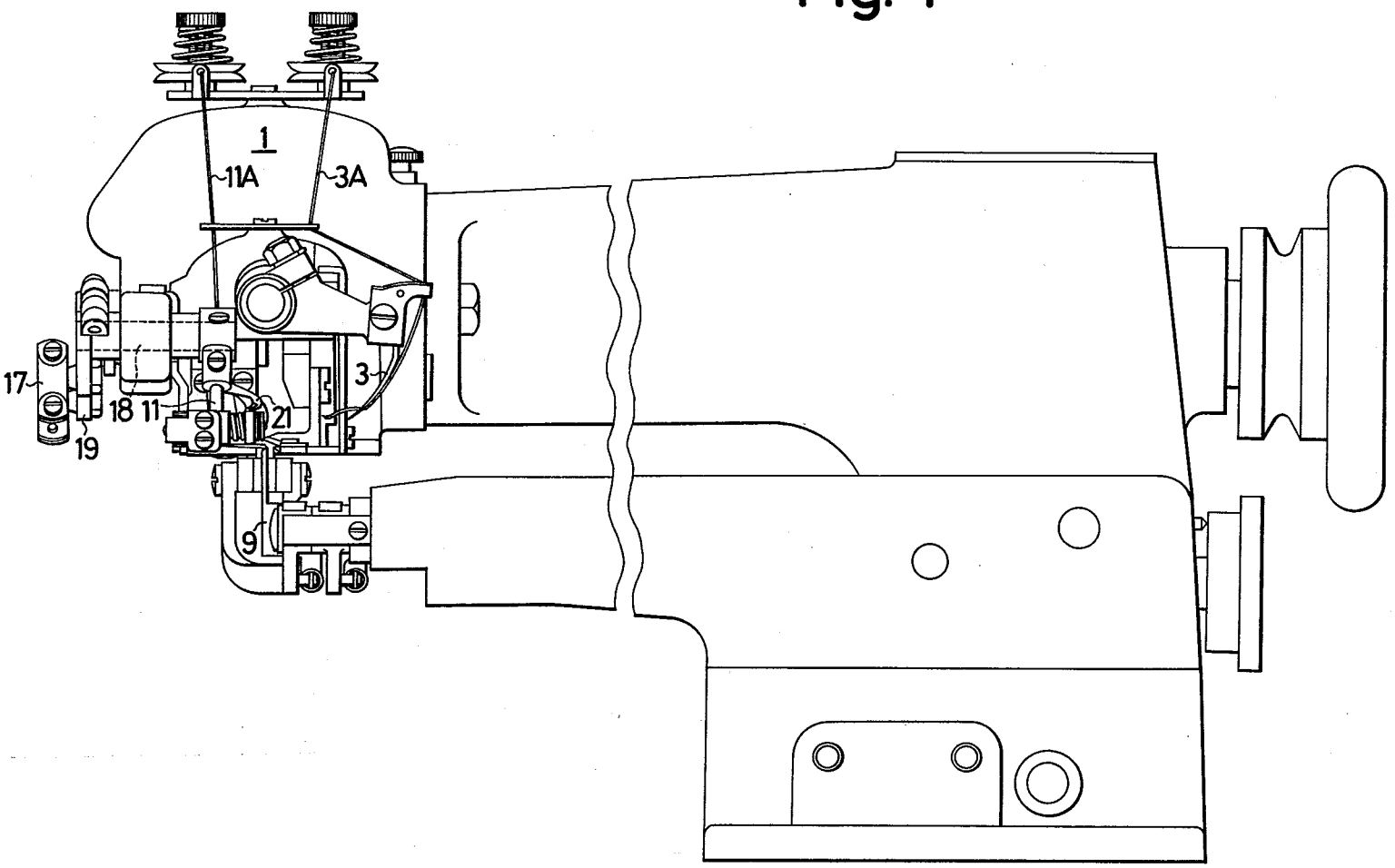
FIG. 1 is a front view showing an embodiment of a sewing machine according to the invention.
Figure 2:
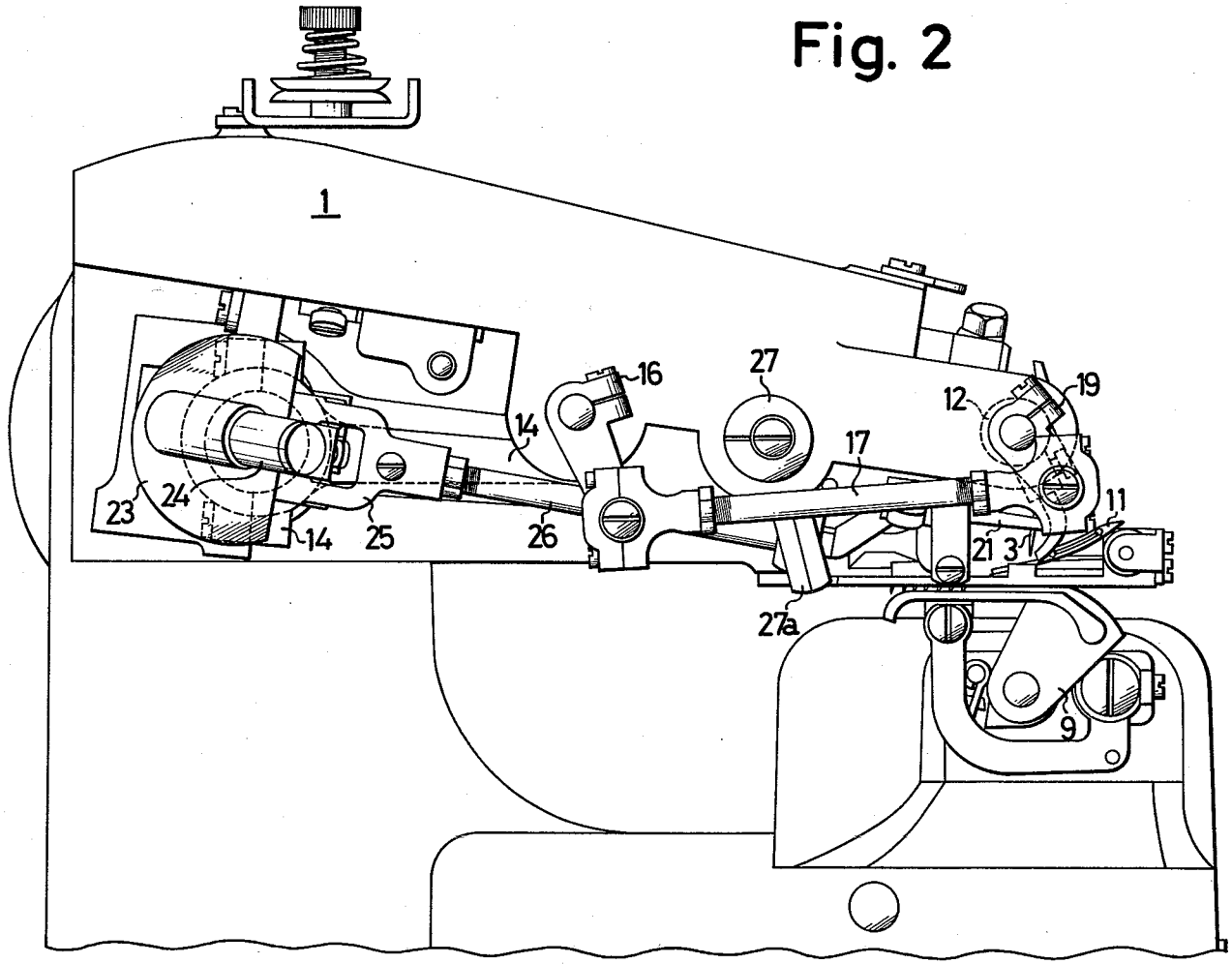
FIG. 2 is a side view of the machine shown in FIG. 1.
Figure 3:
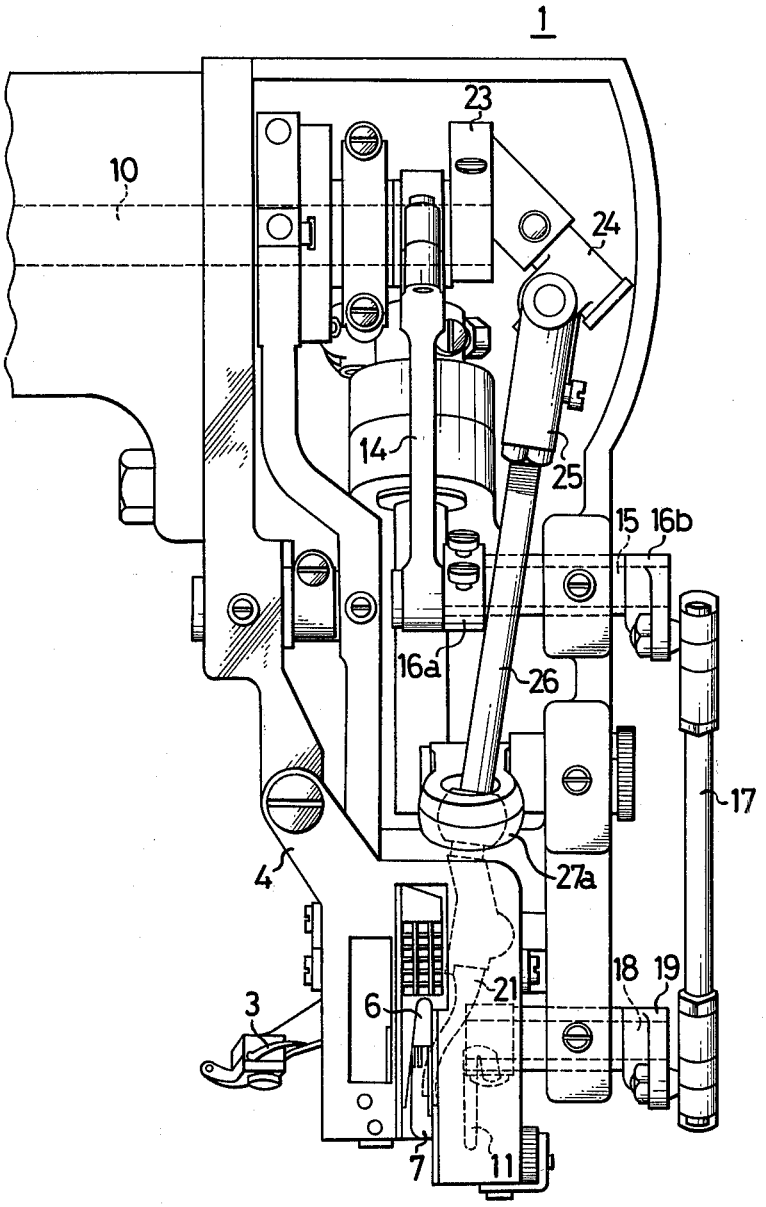
FIG. 3 is a bottom view of the machine shown in FIG. 1.
Figure 4:
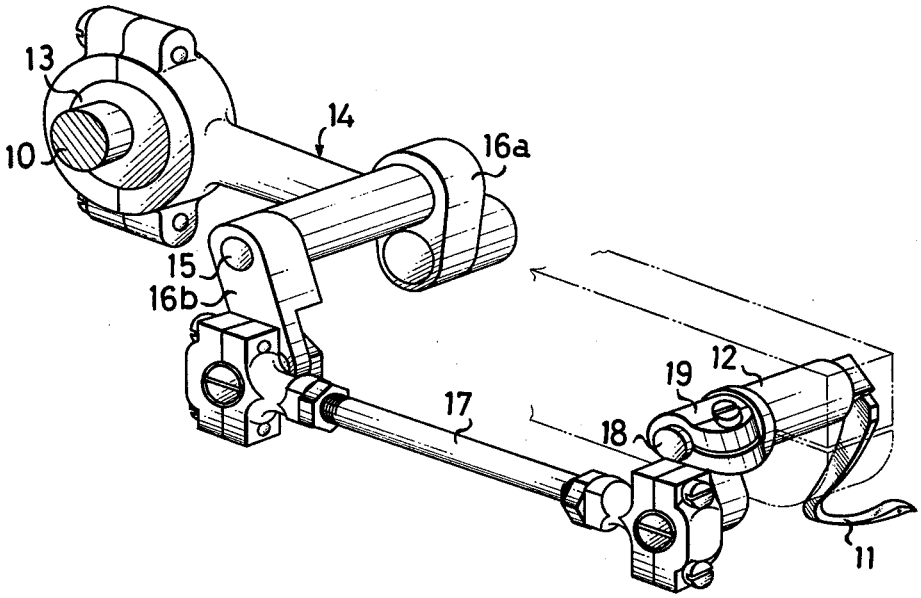
FIG. 4 is an isometric view showing an embodiment of a swinging mechanism of a first looper used in the sewing machine shown in FIG. 1.

In an embodiment shown in FIG. 4 an eccentric rotary plate 13 is secured on a driving shaft 10 and is rotatively fitted to one end of an arm 14, the other end of which is pivoted to one 16*a* of levers 16*a*, 16*b* fixed on both ends of a shaft 15 pivoted on a frame 1. The other lever 16*b* is connected with a lever 19 fixed to one end of a shaft 18 rotatably mounted on the frame 1 through the intermediary of a link 17. A looper mounting unit 12 is fixed to the other end of the shaft 18.

Figure 5:
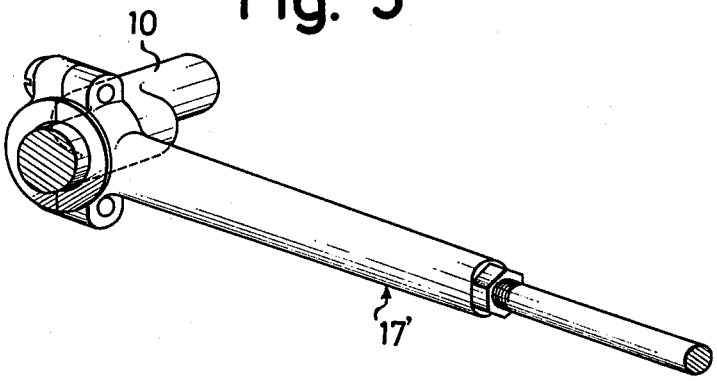
FIG. 5 is an isometric view showing another embodiment of the swinging mechanism.

In another embodiment of a mechanism for swinging a looper shown in FIG. 5, a crank shaft 20 eccentrically mounted on a driving shaft 10 is connected with one end of a shaft 18 pivotally mounted on a frame 1 through a link 17'. A looper mounting unit 12 also is fixed to the other end of the shaft 18.

In respect to the above mentioned looper mounting unit 12, a first looper is mounted directly on a swinging lever 12A fixed on the one end of the shaft 18, as shown in FIGS. 1–5 and 6(*a*).

Figure 6A:
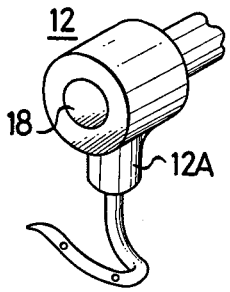
FIGS. 6(*a*) is an isometric view showing a looper mounting unit of the mechanism for swinging the first looper shown in FIG. 4 or FIG. 5.
Figure 6B:
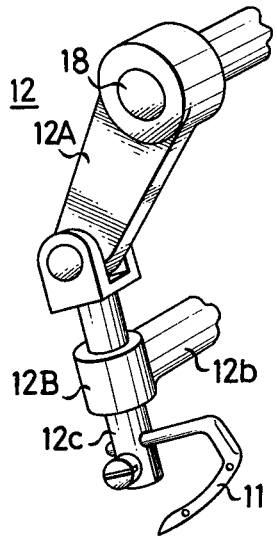

In another embodiment of mounting unit 12 shown in FIG. 6(*b*), a swinging lever 12*a* is fixed to one end of a shaft 18 which pivots a rod 12C which is fitted to slide into a guide sleeve 12B on a support pin 12*b* pivotally mounted on frame 1. A first looper 11 is mounted on a leading end of the rod 12*c*.

Figure 7:
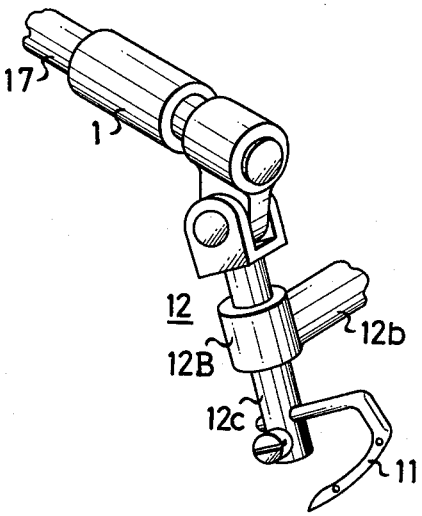
FIG. 7 is an isometric view showing a further embodiment of the same unit as shown in FIG. 6(*a*)

In a further embodiment of the mechanism for swinging a first looper, as shown in FIG. 7, a crank provided on shaft 10 may be connected through the intermediary of a link 17 provided to slide on frame 1 to a rod which is fitted to slide into a guide sleeve 12*c* on a support pin 12*b* pivotally mounted on frame 1.

It will be understood that operation of the first looper has little difference according to the construction of the looper mounting unit 12 as mentioned above. Generally, in order to hook thread by means of a second looper, it is convenient to have the thread hook onto the leading end of the first looper at the start and end of the swing of the latter. However, since its structure becomes complicated, the structure of the mounting unit 12 may be selected suitably according to applications.

Figure 14:
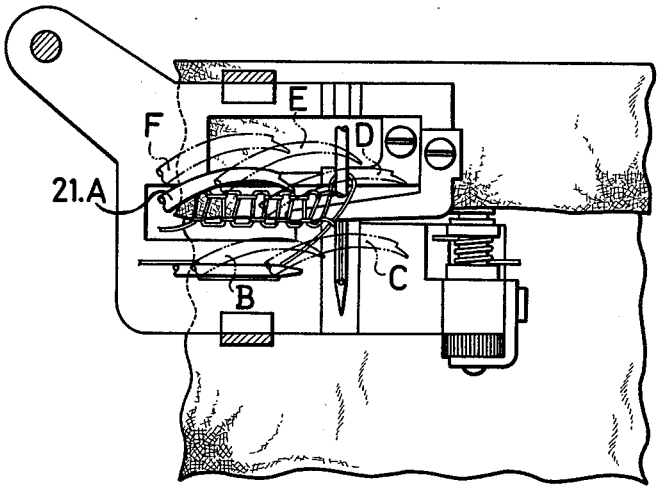
FIG. 14 illustrates the locus of motion of the second looper, with reference characters (A)–(F) corresponding to the position of the second looper in FIG. 10 A–F.

A swinging mechanism of a second looper is provided with an eccentric rotary plate or a crank or a universal joint disposed on a driving shaft 10, whereby the above element is connected with a looper mounting unit 21 having a second looper 22 through the intermediary of a suitable link mechanism so that the second looper moves along a closed curve resembling the three dimensional outline of a saddle as shown in FIG. 14.

Figure 9:
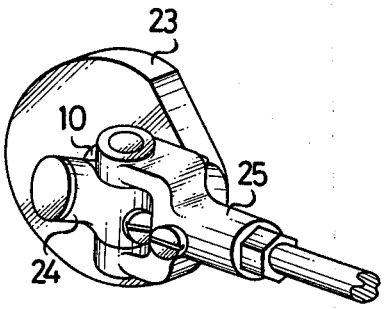
FIG. 9 is an isometric view showing another embodiment of the mechanism for swinging the second looper.
Figure 8A:
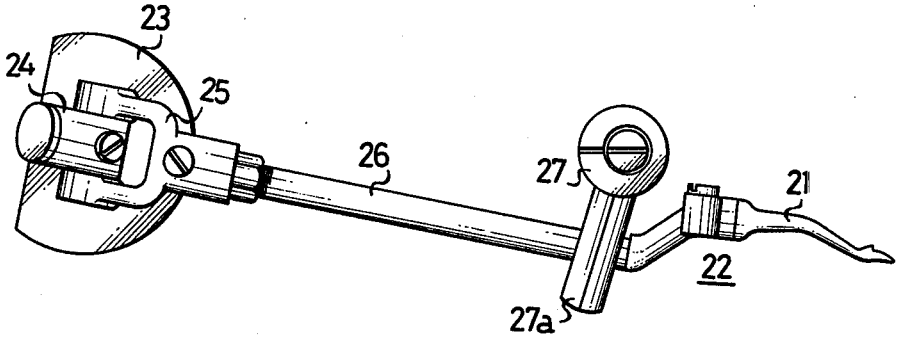
FIGS. 8A–F are front views showing a swinging mechanism for a second looper used in the sewing machine according to the invention in six consecutive positions thereof.
Figure 8B:
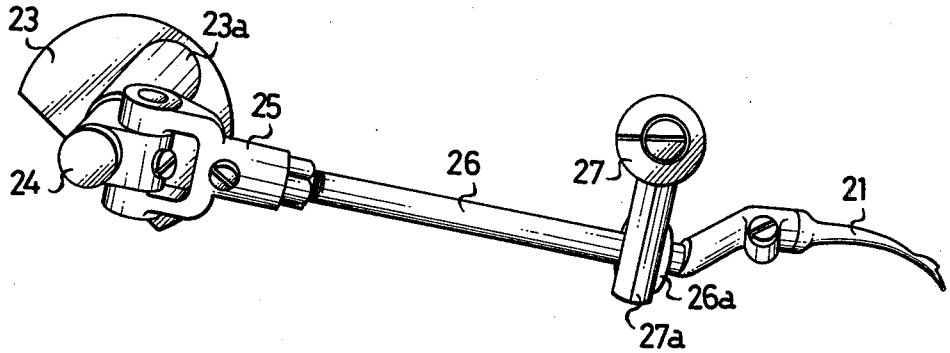
Figure 8C:
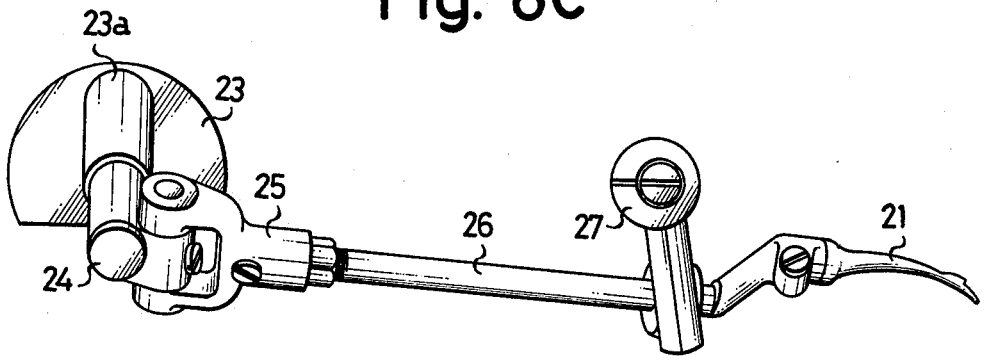
Figure 8D:
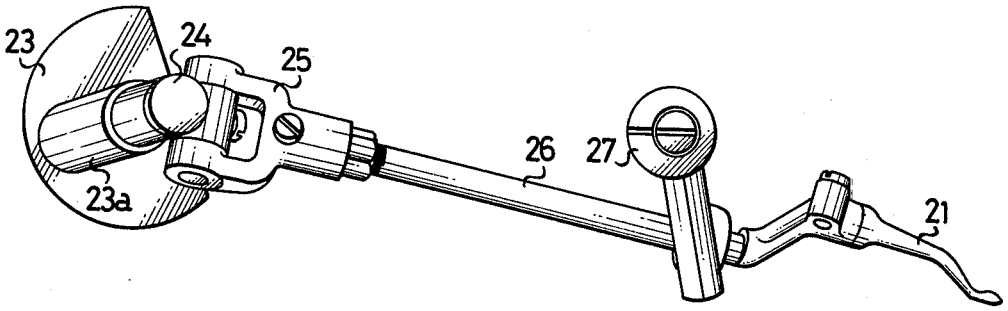
Figure 8E:
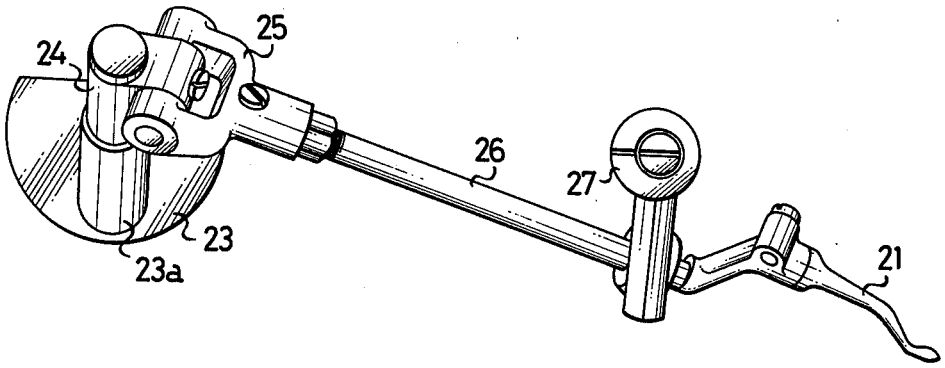
Figure 8F:
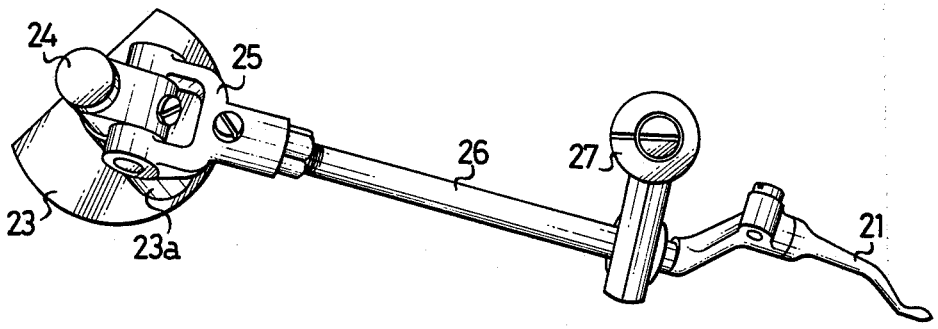

Referring to FIGS. 8 and 9, a convex portion 23*a* is protruded slantingly from an eccentric portion of a rotary plate 23 fixed on a driving shaft 10. The convex portion 23*a* is rotatively disposed with one end of a cross sleeve 24, the other end of which is fitted and fixed into a pin 25*a* provided on a bifurcated lever 25. A rod is provided in line with the bifurcated lever 25 and has a spherical portion 26*a* expanded on the rod. The spherical portion 26*a* is fitted and engaged into a bearing ring 27*a* provided on a lever 27 pivotally mounted on a frame 1 at its one end thus free for direction and rotation of the rod 26, on a leading end of which a second looper is mounted. It will be understood that selection of the mechanisms for swinging a second looper shown in FIGS. 8 and 9 depends on a rotational direction of the driving shaft.

The following description will be made in respect to operation of a blind needle, a first looper and a second looper when sewing by the machine according to the invention.

Figure 10A:
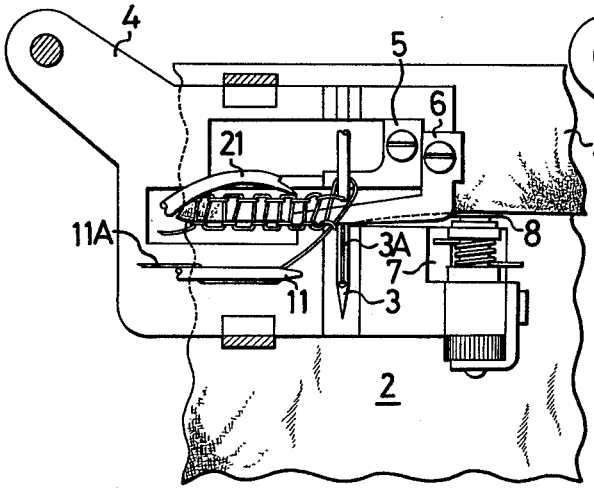
FIG. 10 shows the sewing steps (a)–(f) of forming a blind stitch on a hem using two threads.
Figure 10B:
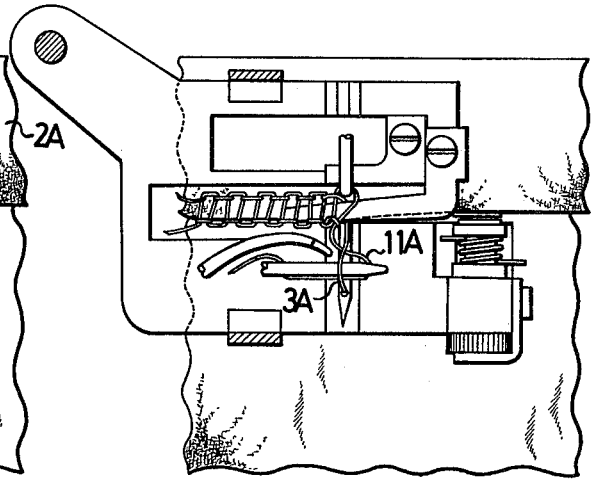
Figure 10C:
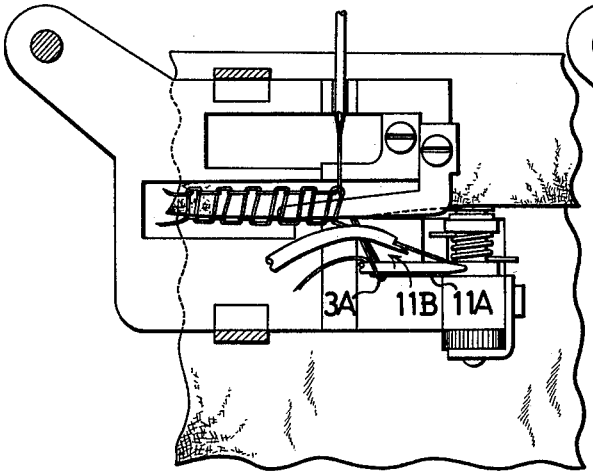
Figure 10D:
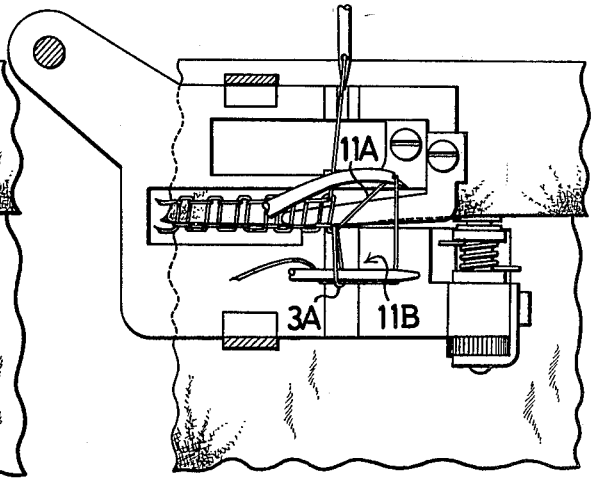
Figure 10E:
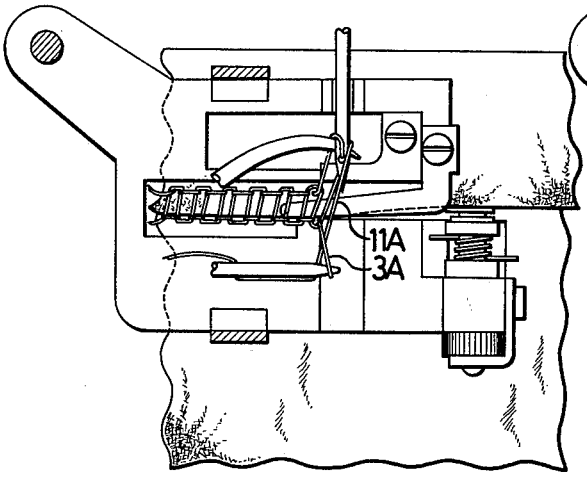
Figure 10F:
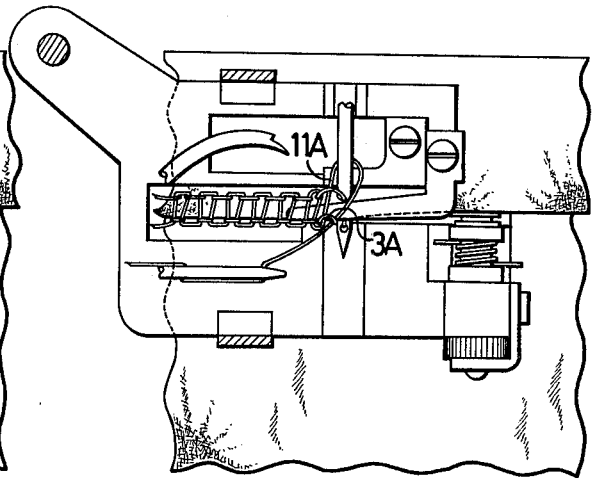
Figure 11:
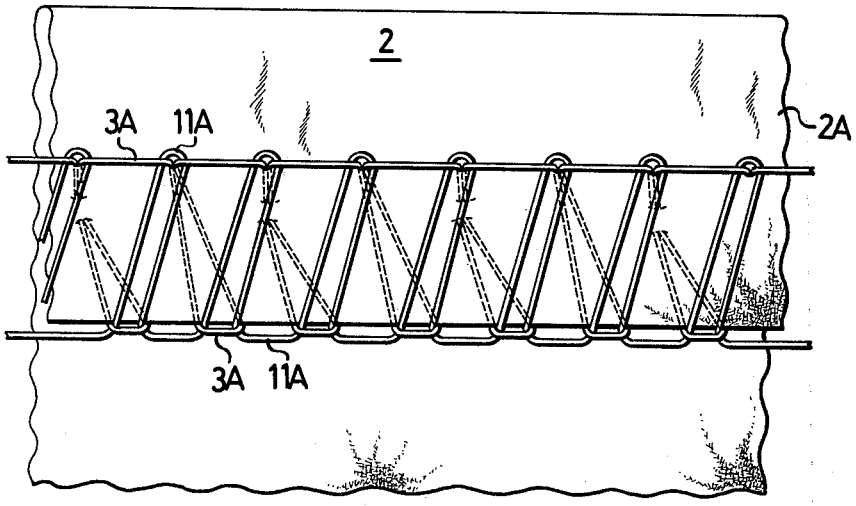
FIG. 11 shows seams sewn according to the steps shown in FIG. 10.

In FIG. 10 using two threads for sewing, first a blind needle 3 passes through a cloth 2 together with a thread 3*a* (FIG. 10(A)). Next, a first looper 11 carrying a looper thread is run between the thread 3A and the needle. (FIG. 10(B)). Further, the blind needle 3 is withdrawn and then a second looper 21 hooks the looper thread 11*a* to expand a loop 11B of the thread 11A (FIG. 10(C) and (D)). Subsequently, the first looper 11 withdraws and the blind needle 3 is run together with the threads 3A in the expanded loop 11B (FIG. 10(E)). Finally when the second looper 21 withdraws and leaves from the loop 11B, the blind needle 3 passes through the cloth 2 together with the thread 3A (FIG. 10(F)). By repeating the above operations a sewing line is obtained as shown in FIG. 11 (a 2-1 skip stitch is shown by way of example) and it is a combined sewing of hem stitch and blind stitch.

Figure 12A:
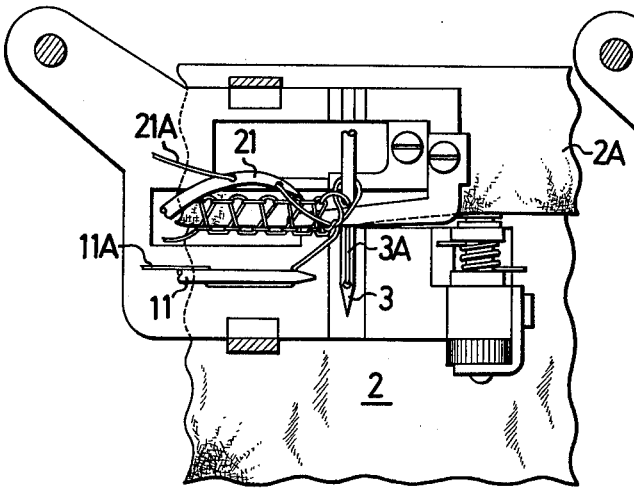
FIG. 12 shows sewing steps (a)–(f) forming a blind stitch on a hem using three threads.
Figure 12B:
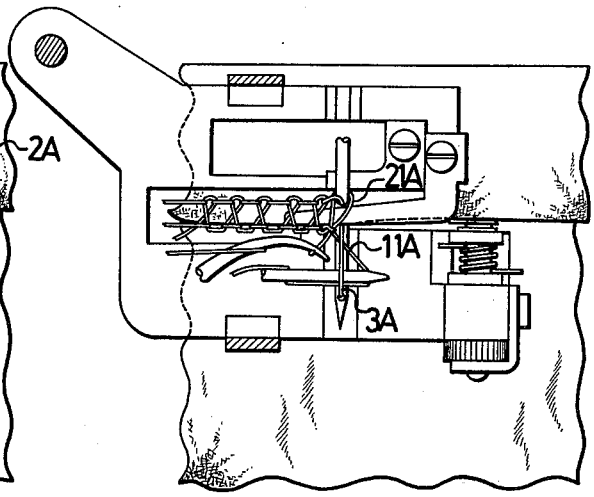
Figure 12C:
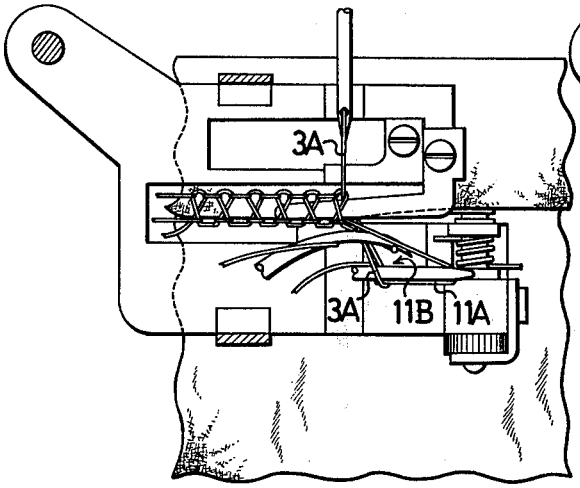
Figure 12D:
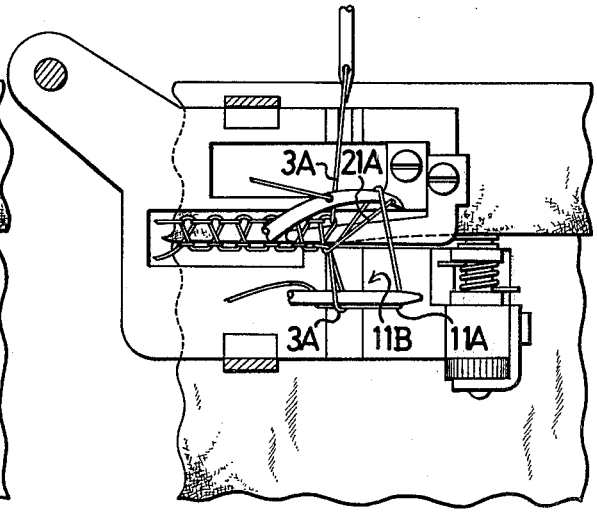
Figure 12E:
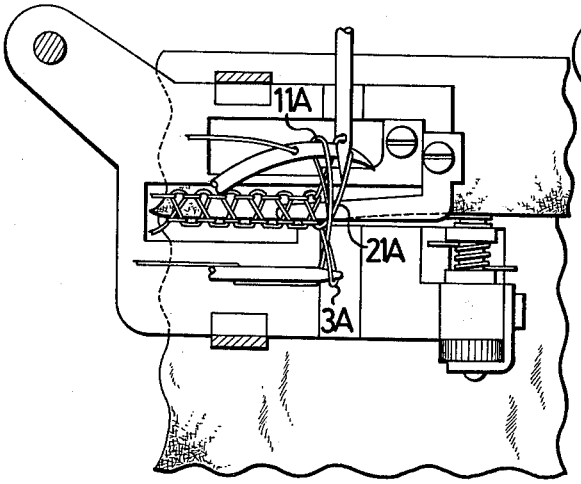
Figure 12F:
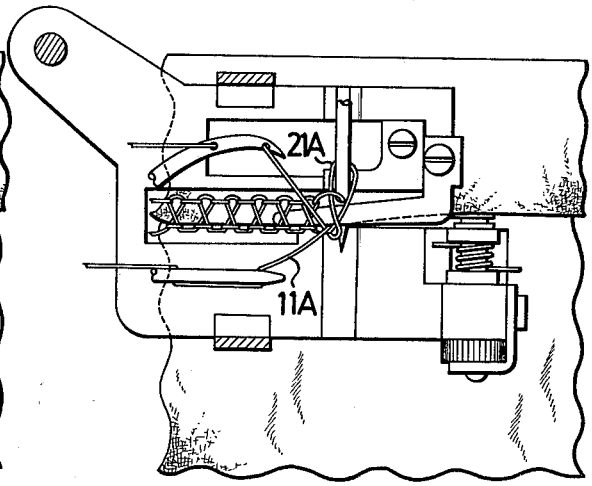
Figure 13:
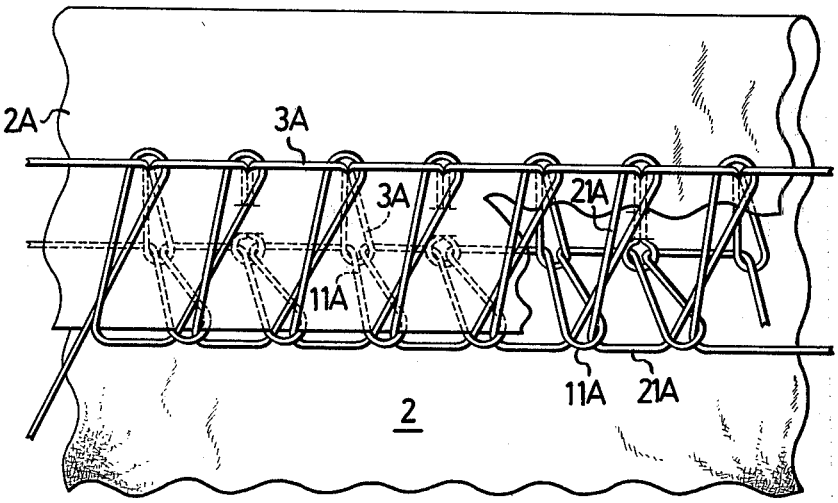
FIG. 13 shows seams sewn according to the order shown in FIG. 12.

In FIG. 12 using three threads for sewing, first a blind needle 3 passes through a cloth 2 together with a thread 3A (FIG. 12(A)). Next, a first looper 11 is run together with a first looper thread 11A into the thread 3A (FIG. 12(B)). Further, the blind needle 3 withdraws and a second looper 21 hooks the first looper thread 11A while running a second looper 21 together with a second looper thread 21A into a loop 11B of the first looper thread 11A (FIG. 12(C) and (D)). Subsequently, the first looper 11 withdraws and then the blind needle 3 is run together with the thread 3A into the thread 21A of the second looper 21 (FIG. 12(E)). Finally, when the second looper 21 withdraws and leaves from the loop 11B of the first looper thread, the blind needle 3 passes through the cloth 2 together with the thread 3A (FIG. 12(F)). By repeating the above operations a sewing line is obtained as shown in FIG. 13 and it is a combined sewing of hem stitch and blind stitch. Regarding the other reference numerals a throat plate is shown at 4, a needle guide at 5, a seam securing piece at 6, an upper pressure plate at 7 the folded hem portion at 2*a*, and a scale at 8. In respect to a track which is drawn by the second looper 21, this presents a loop like a circumfrential edge of a saddle turned up at both ends since the rod 26 swings with a torsion as a fulcrum about the bearing ring 27*a*. In the embodiment shown, the rod rotates in an inner direction when seeing it from the upper part. At this time the thread is hooked at a right end of the saddle-like loop.

It will be understood that the sewing by machine of the invention can be performed not only in a case sewing a folded back portion of the cloth as shown in Figures but also in a case of overlapping of more than two cloths. In the same manner, it can sew underclothing, overclothing or the like without selecting kinds of cloth. An operation of sewing the cloth with the blind needle may be performed on each desired seam depending on adjustment of a cloth lifting mechanism 9. In the sewing shown in Figures, the blind stitch is performed to jump over one by one. In the machine of the invention, the inside and outside of the seam may be reversed by reversing the operations of the blind needle, the first looper and the second looper from those of the shown embodiment.

As can be understood from the above description, with the invention, the sewing processes are significantly simplified and are high in efficiency with the performance at the same time of the hem stitch and the blind stitch.

According to the sewing machine of the invention, the finish is beautiful since the seam of the hem stitch does not overlap the seam of the blind stitch and raveling of the seam does not extend to the other seam since the sewing is performed by more than two threads and the raveling halts at its seam if one of the threads is cut.

As many apparent and widely different embodiments of this invention may be made without departing from the spirit and scope thereof, it is to be understood that the invention is not limited to the specific embodiments thereof except as defined in the appended claims.

What is claimed is:

1. A sewing machine adapted to simultaneously perform hem stitch and blind stitch, comprising a seam stabilization piece: a first looper placed above one side of a hem of cloth to be stitched and along the hem reciprocated to cross with a blind needle which is passed through the cloth; a second looper placed above the hem to be stitched; and means for moving said second looper along a loop-like closed curve resembling the three dimensional outline of a saddle in synchronism with the reciprocation of said first looper so as to pass said second looper along alternate sides of the hem and crossing between said sides without contacting said seam stabilizing piece.

2. A sewing machine as set forth in claim 1, in which said first looper is mounted on a leading end of a looper mounting unit which is connected with an eccentric rotary body provided on a driving shaft through the intermediary of a suitable link mechanism so as to swing said looper mounting unit whereby said first looper is reciprocated in a arch shape.

3. A sewing machine as set forth in claim 2, in which said eccentric rotary plate fixed on said driving shaft is rotatively fitted at one end of an arm the other end of which is pivotally mounted on one of two levers fixed on respective ends of a shaft pivotally mounted on a frame, and the other lever of said levers is connected through the intermediary of a link with a second lever fixed on one end of a second shaft pivotally mounted on said frame, said looper mounting unit being fixed to the other end of said last mentioned shaft.

4. A sewing machine as set forth in claim 3, in which a crank shaft provided on said driving shaft is connected through a link with said second lever fixed on the one end of said second shaft and said looper mounting unit is fixed to the other end of said shaft.

5. A sewing machine as set forth in claim 3 or 4, in which said looper mounting unit is constituted to mount said first looper directly on a swinging lever fixed on the one end of said second shaft.

6. A sewing machine as set forth in claim 3 or 4, in which said looper mounting unit is pivotally provided with a rod fitted to slide in a guide sleeve on a support pin pivotally mounted on said frame and said first looper is mounted on a leading end of said rod.

7. A sewing machine as set forth in claim 6, in which said eccentric rotary body provided on said driving shaft is connected to said rod of said looper mounting unit to slide said rod into said guide sleeve on said support pin pivotally mounted on said frame.

8. A sewing machine as set forth in claim 1, in which said second looper is mounted on a looper mounting unit which is connected with an eccentric rotary plate or a crank or a universal joint provided on said shaft through a suitable link mechanism whereby said second looper is adapted to draw a loop-like track in generally a saddle shape.

9. A sewing machine as set forth in claim 8, further comprising a convex portion slantingly protruded from the eccentric portion of said rotary plate fixed on said driving shaft, a cross sleeve connected to rotate with said convex portion at one end and at the other end fitted and fixed to a pin supported on a bifurcated lever, a rod provided in line with said bifurcated lever and having a spherical portion expanded therefrom, and a bearing ring provided on a lever pivotally mounted on said frame at its one end, said spherical portion being fitted and engaged into said bearing ring to be free for direction and rotation of said rod at a leading end of which said second looper is mounted.

10. A sewing machine adapted to simultaneously perform hem stitch and blind stitch, comprising:

a first looper placed above one side of the cloth hem to be stitched;

a looper mounting unit, said first looper being mounted on the end of said mounting unit;

an eccentric rotary body mounted on a driving shaft; said body being rotatively fixed to one end of an arm, the other end of said arm being pivotally mounted on one of two levers fixed on respective ends of a shaft pivotally mounted on a frame, the other of said levers being connected through the intermediary of a link with a second arm fixed on one end of a round shaft pivotally mounted on said frame, said first looper unit being fixed to the other end of said second arm so as to reciprocate said first looper in an arch shape crossing with a blind needle which is passed through the cloth;

a second looper placed above the hem to be stitched; and means for moving said second looper along a loop-like closed curve resembling the three dimensional outline of a saddle in synchronism with the reciprocation of said first looper so as to pass said second looper along alternate sides of the hem and crossing between said sides without contacting said seam stabilizing piece.

11. A sewing machine adpated to simultaneously perform hem stitch and blind stitch, comprising:

a first looper placed above one side of the cloth hem to be stitched;

a looper mounting unit, said first looper being mounted on the end of said mounting unit;

a driven crank shaft, in which the crank is connected through a link with a first of two levers fixed on respective ends of a shaft pivotally mounted on a frame, and the said looper mounting unit is fixed to the other end of said shaft so as to reciprocate said first looper in an arch shape motion crossing with a blind needle which passes through the cloth;

a second looper placed above the hem to be stitched and a seam stabilizing piece; and means for moving said looper along a loop-like closed curve resembling the three-dimensional outline of a saddle in synchronism with the reciprocal motion of said first looper so as to pass said second looper along alternate sides of the hem and crossing between said sides without contacting said seam stabilizing piece.

* * * * *